US005323576A

United States Patent [19]

Gumpert et al.

[11] Patent Number: 5,323,576

[45] Date of Patent: Jun. 28, 1994

[54] METAL ROOFING SKYLIGHT

[75] Inventors: Larry Gumpert, Belton; Cecil A. Bickford, Pearland, both of Tex.

[73] Assignee: Sequentia, Incorporated, Cleveland, Ohio

[21] Appl. No.: 991,380

[22] Filed: Dec. 16, 1992

[51] Int. Cl.[5] ..... E04B 7/18; E04B 1/346

[52] U.S. Cl. ..... 52/200; 52/72; 52/788

[58] Field of Search ..... 52/58, 60, 200, 584, 52/72, 202, 203, 788

[56] References Cited

U.S. PATENT DOCUMENTS

| | | | |
|---|---|---|---|
| 4,073,097 | 2/1978 | Jentoft et al. | 52/22 |
| 4,428,169 | 1/1984 | Tsakiris | 52/200 |
| 4,473,979 | 10/1984 | Bruhm | 52/200 |
| 4,649,680 | 3/1987 | Weisner et al. | 52/200 |
| 4,825,608 | 5/1989 | Makin | 52/200 |
| 4,848,051 | 7/1989 | Weisner et al. | 52/200 |
| 4,860,511 | 8/1989 | Weisner et al. | 52/200 |
| 4,986,039 | 1/1991 | Weisner | 52/200 X |
| 5,046,292 | 9/1991 | Sampson et al. | 52/200 |

*Primary Examiner*—Neill R. Wilson

*Attorney, Agent, or Firm*—Vickers, Daniels & Young

[57] ABSTRACT

A skylight system and method of making the same for use on metal roofs, such as those of the standing seam variety, in which the edges of the light-admitting opening are folded back away from this opening to form a lip surrounding the opening. The system further includes a bubble-shaped cover which completely covers the opening and lip and a retaining ring which is bonded to the cover and the roof to form a watertight seal around the opening.

44 Claims, 11 Drawing Sheets

METAL ROOFING SKYLIGHT

The present invention relates to a skylight system for roofs, and more particularly to a leakproof curbless skylight light system.

DESCRIPTION OF THE PRIOR ART

Skylight systems allow natural light into a building while keeping out the elements. These systems generally consist of a transparent section for letting in light and an attachment section for joining the transparent section to a roof. These sections must be securely joined to each other and to the roof or water may leak into the building below. Leaking water is one of the most serious problems which must be addressed when designing and installing a skylight system.

Skylights are often installed in metal roofing systems of the standing seam variety. Such roofs are formed by parallel metal panels, the lateral edges of which are folded up perpendicular to the panel and attached to the upstanding lateral edge of the adjacent panel with a cap piece, or the upstanding edges are folded over to hold them tightly together. The roofs are sloped so that water runs down the trough formed between the upstanding edges of each panel. This provides for a leak-free roof under normal conditions. However, if one of the troughs were to become blocked, the level of water therein would rise and could penetrate the seam of the joined together panels from beneath.

Skylights for use in these systems, therefore, generally allow room between the skylight and the upstanding seam so that water can flow down the roof and around the skylight. When the temperature fluctuates about the freezing point of water however, problems can occur. If water is not smoothly diverted around the skylight, ice and snow can collect on the upstream side of the skylight. During a warm period this ice may shift and become lodged between the skylight and upstanding seam. This alone may block the flow of water around the skylight, or the area may refreeze and form an even more impenetrable barrier. This is known as the ice dam problem and must be addressed when designing skylights for metal roofing systems.

Typically, installing a skylight requires breaching the integrity of a sealed roof in a plurality of locations. The first breach provides an opening to admit light, which is likely to be several square feet in area. This opening will have a perimeter several feet long, all of which must be made watertight. Because many skylights have a curved or domed shape, winds blowing over this curved surface tend to pull the skylight away from the roof thus further stressing the integrity of the seal. Furthermore, nails or screws used to hold the components of the skylight system to the roof create additional potential leakage sites. Large amounts of sealant are therefore needed, but do not ensure a completely watertight system.

It is difficult to form a watertight seal between a plastic or glass transparent cover and a metal or shingled roof below. This is due in part to the difference between the coefficients of expansion of the materials which stresses any seal that is attempted. A common way of avoiding the necessity of forming such a seal is to build a structure known as a curb. A curb is a raised platform which surrounds the opening on a roof. It is made from a material such as wood which can be readily affixed to the roof using traditional roofing techniques. A transparent cover can then be attached to the top of the curb. It is easier to attach the cover to a curb because the curb can be readily modified to fit against the cover. Furthermore, the curb raises the problematic seal under the cover to a point above the level of flowing water draining off of a roof. The resulting structure contains a seal between the curbs and roof using traditional methods and an improved seal between the curb and cover which will not be subject to a continuous flow of water.

Curbed systems, however, have problems of their own, not the least of which is cost. Curbs are often the most expensive part of such a skylight assembly. Furthermore, curbs are quite heavy and often require that additional support be provided in the area around the skylight. Constructing the seal between the curb and roof requires time, skill, and a large amount of sealant. If the artisan installing the curb is not careful, leaks may develop which will be costly and difficult to repair. The curb also results in a high profile which may not be aesthetically desirable.

An added problem with curbed skylights is that they require a hole to be cut through a sealed roof. Not only does this provide potential openings for water as discussed above, but cutting a hole and building the curb require on site labor. It will be appreciated that using skilled labor at a job site to cut holes and build curbs often costs substantially more than does the transparent cover, the element of the system which will be most appreciated by the end user.

SUMMARY OF THE INVENTION

To overcome these problems, the present invention includes a metal roofing panel having a hole punched therein, a transparent bubble that fits over the hole, and a retaining ring which surrounds the hole and base of the bubble. The edges of the hole are bent back away from the opening to form a continuous lip around the hole, within the bubble. This lip prevents any water which penetrates the outer seals from entering the opening in the roof. The retaining ring overlies a horizontal brim portion of the bubble and directly overlays a portion of the surrounding metal roof panel. The retaining ring is bonded to the roofing panel with a chemical adhesive and to the plastic bubble with a flexible, watertight adhesive. The cover is also bonded to the metal panel with a flexible, watertight adhesive. A second bubble-shaped cover may also be included between the opening and the first cover to provide added protection against leakage as well as additional insulation. The retaining ring is shaped to direct water away from the bubble to avoid the formation of ice dams.

In accordance with the invention, a skylight is made by punching a hole in a metal roofing panel, bending the edges of this hole back from the opening and sealing a bubble over the hole using chemical adhesives and a retaining ring. Significantly, all of these steps occur in the factory manufacturing the unit. Thus, not only are the conditions under which assembly occurs carefully controlled, but what is delivered to the work site is a completed assembly which can be installed like any other roofing panel.

Further in accordance with the invention, a curbless skylight is disclosed which includes a metal roofing panel having a hole punched therein, and a plastic cover over that hole. The cover is secured to the roofing panel using a retaining ring which surrounds the cover and is secured to the cover and to the roofing panel. As will be understood, the above assembly avoids the problems associated with installing a skylight on site and reduces the operation to that of installing an ordinary metal roofing sheet.

In an alternate embodiment, an ordinary metal panel may be used instead of a roofing panel. This metal panel could then be installed over a hole cut in a metal roof and chemically bonded to the roofing panel. This permits many of the benefits of the first embodiment to be realized in an existing roofing system without requiring the removal of an existing panel.

It is therefore a principal object of this invention to provide a skylight system for installation in a metal roof of the upstanding seam type.

It is another objective to provide a skylight assembly which can be installed in essentially the same manner as an ordinary roofing panel.

It is a further objective of the invention to provide a leakproof skylight assembly of simple construction.

It is yet another objective of the invention to provide a skylight system in which a portion of the roofing material itself forms a lip to prevent leakage.

It is another objective of the present invention to provide a skylight system which is completely assembled away from the job site.

Yet another objective of the present invention is to provide a method of fabricating a complete skylight away from the job site.

Still another objective of the present invention is to provide a skylight which minimizes the affect of thermal expansion and contraction on the seal between the skylight and the roof.

It is another objective of the present invention to provide a skylight system which is securely attached to a roofing system.

A further objective of the present invention is to provide a skylight system which does not contribute to the formation of ice dams.

It is yet another objective of the present invention to provide a prefabricated skylight assembly which can be installed over a hole cut in a roofing panel in an existing metal roof.

These and other objectives and advantages of the invention will become apparent from the following detailed description when read in conjunction with the drawings.

DETAILED DESCRIPTION OF THE PREFERRED EMBODIMENT

Reference is now made to the drawings wherein the showings are for the purpose of illustrating a preferred embodiment of the invention only and not for the purpose of limiting same. The present invention comprises an improved curbless skylight system which is watertight and installs in the same manner as an ordinary metal roofing panel, and a method for making the same.

Figure 1:
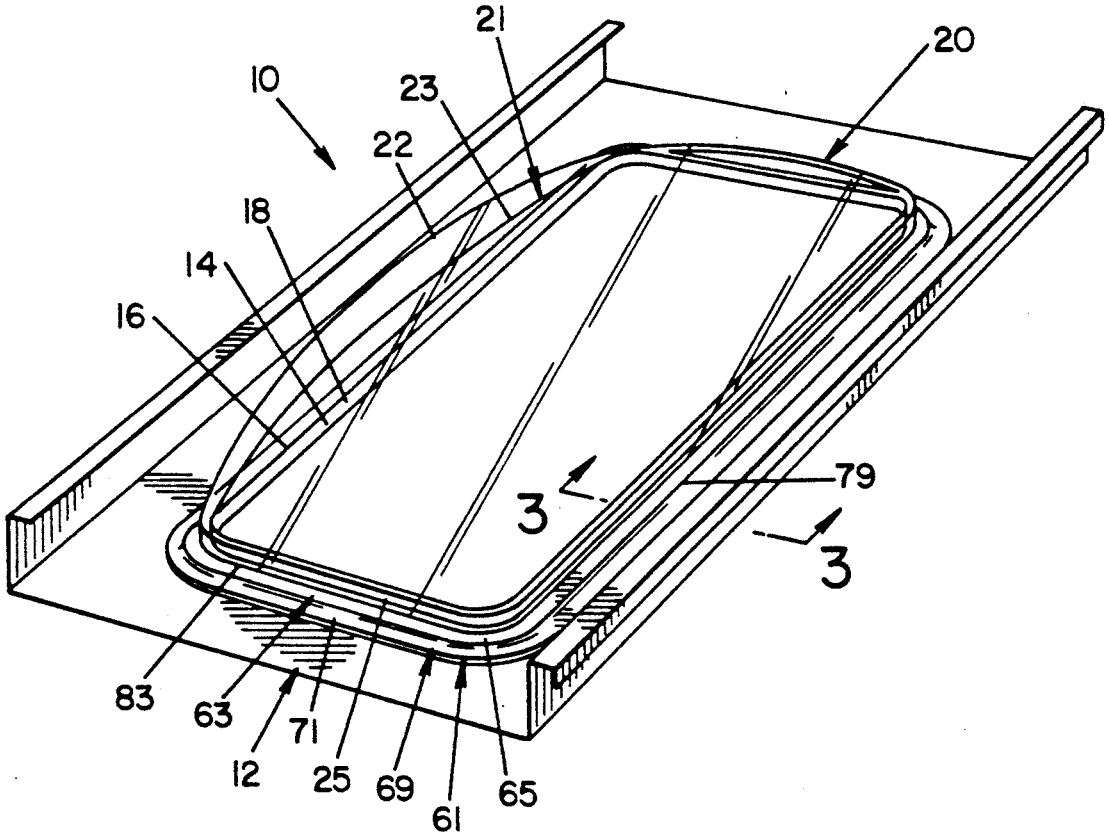
FIG. 1 is a perspective view of an assembled skylight.

Skylight 10 as shown in FIG. 1 is intended for installation in a metal roofing system of the standing seam variety. Such roofs are generally inclined so that rain water flows over and off of the roof and does not collect in puddles. This flowing water is the cause of many of the leakage problems common to skylights. For convenience herein, however, the metal roofing panel will be treated as lying flat for purposes of description even though it will ultimately be installed in an orientation inclined from the horizontal.

Figure 2:
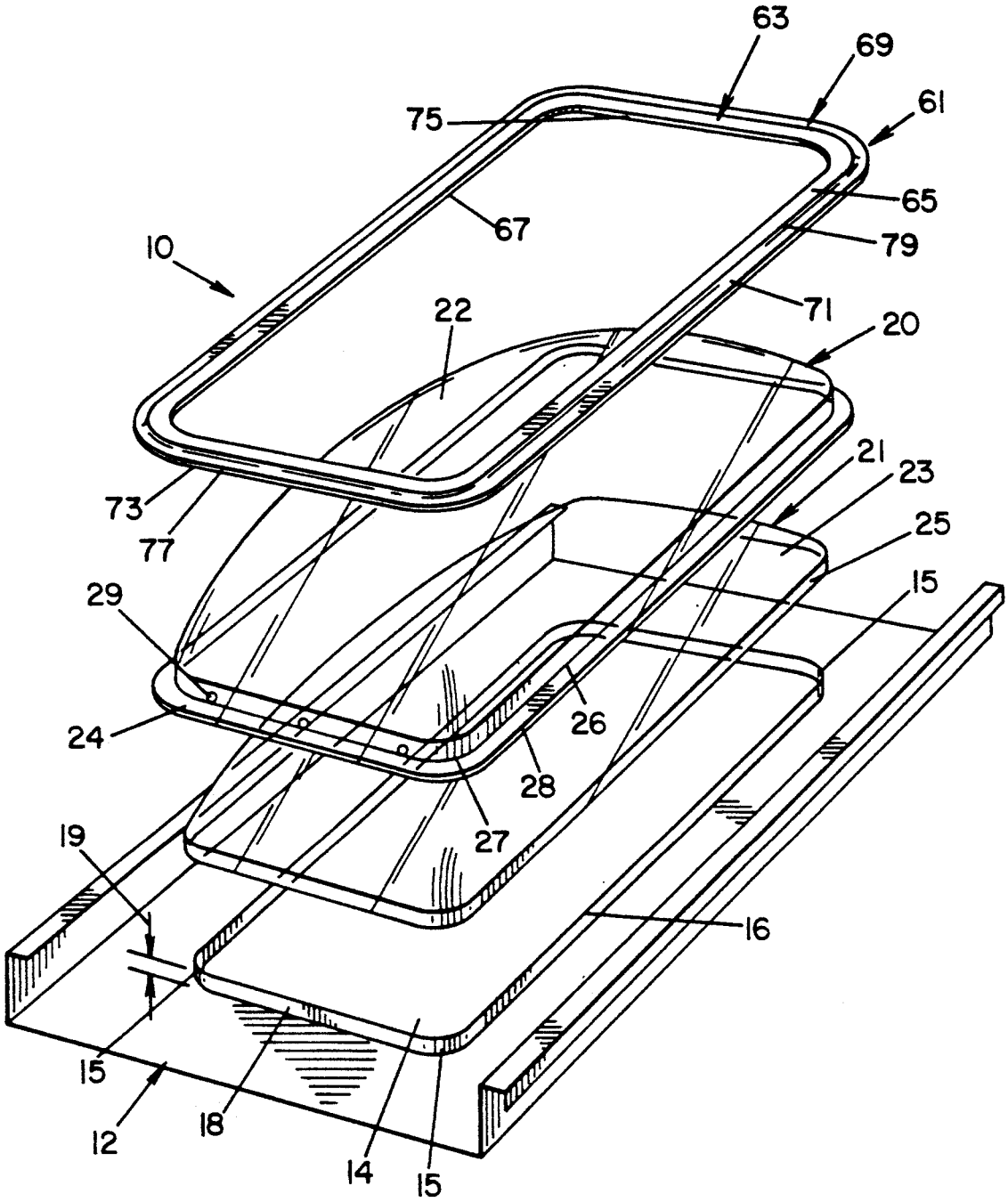
FIG. 2 is an exploded view of a skylight according to the present invention.
Figure 8:
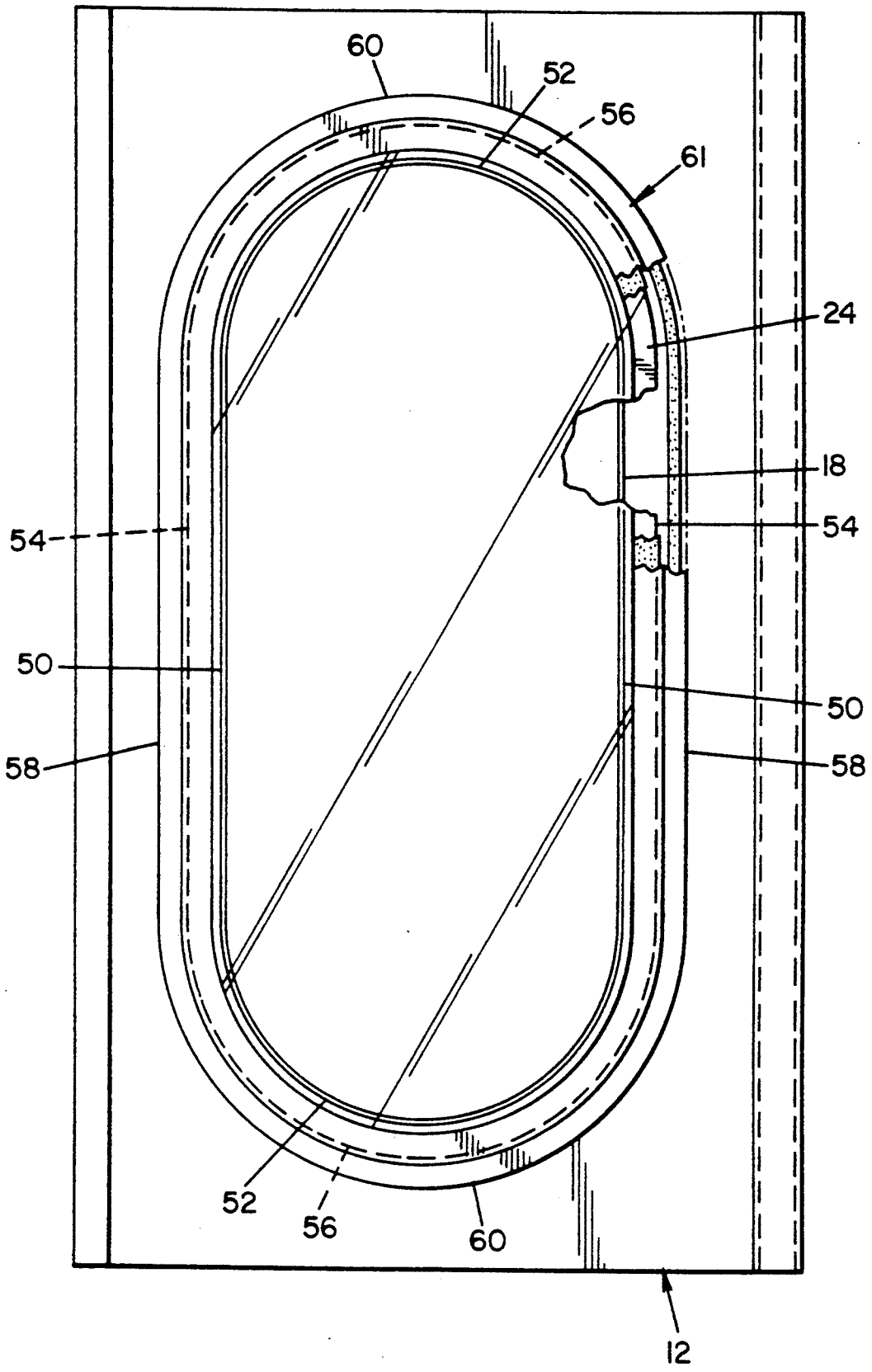
FIG. 8 is a top view, partially in section of an embodiment of the skylight of FIGS. 1 and 2 having full radius ends.

FIG. 2 discloses a skylight which includes a metal roofing panel 12 of the type generally used in standing seam roofing systems. An opening 14 is punched in the panel 12 and the edges 16 thereof are folded back away from the opening 14 to form a lip 18. The opening 14 is generally rectangular with rounded corners 15 or may have full radius ends 52 as shown in FIG. 8. The lip 18 has a generally uniform height 19 and cross section and is generally perpendicular to the panel 12. A compound die may be used to punch out the opening 14 and bend the edges 16 into the lip 18 in one step. It should be noted that as the lip 18 is formed from the panel 12, no openings are created which would permit flowing water to penetrate the lip 18 or pass between the lip 18 and the panel 12. Alternately, if a rectangular opening having square corners is desired, any breach in the lip 18 may be sealed by welding.

Figure 3:
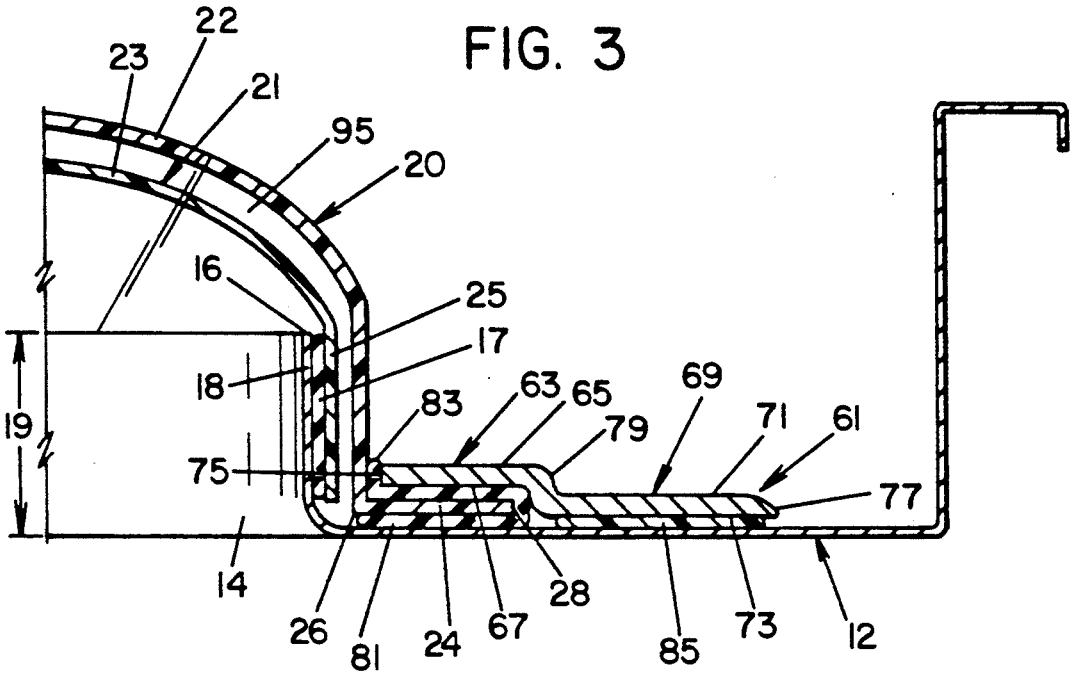
FIG. 3 is a cross-section of the skylight in FIG. 1 taken through plane 3—3.

FIGS. 2 and 3 show a transparent inner cover 21, a transparent outer cover 20, and a retaining ring 61. The inner cover 21 includes a bubble portion 23 and a vertical portion 25. The inner cover 21 is placed over the upstanding lip 18 and the vertical portion 25 is attached to the lip 18 using a layer 17 of elastomeric adhesive. The outer cover 20 includes a bubble portion 22, weeping paths 29 and a horizontal brim 24 formed from a continuous sheet of material or bonded together in such a manner as to be impermeable to water. The bubble 22 and the horizontal brim 24 come together at a bubble periphery 26. The brim 24 is bounded by a cover periphery 28. The bubble periphery 26 is generally rectangular with rounded off corners 27 and conforms generally to the opening 14 and the lip 18. Alternately, the brim may include parallel sides 54 and full radius ends 56 as shown in FIG. 8. The bubble 22 rises from the bubble periphery 26 into an elongated-dome shape. The bubble 22 has no local depressions in which rain water could collect. Water will drain smoothly away from any point on the skylight 10 after falling thereon.

The outer cover 20 may be formed from a material such as acrylic which is slightly permeable to water. It is also possible for small leaks to form between the outer cover 20 and the roofing panel 12 over the lifetime of the skylight 12. Thus, water vapor or liquid water may be present between cover 20 and cover 21. To avoid the buildup of water or the formation of condensation between the inner cover 21 and the outer cover 20, weeping paths 29 are provided in the downstream side of the outer cover 20. These allows any water which enters into the space 95 between the covers 20, 21 to drain away from the skylight 10.

The retaining ring 61 includes an upper portion 63 having a top surface 65 and a bottom surface 67 and a lower portion 69 having a top surface 71 and a bottom surface 73. The ring 61 also includes a vertical side 75 and an outer periphery 77. The upper portion 63 and lower portion 69 are connected by a vertical riser 79. The retaining ring 61 completely surrounds the opening 14 and the bubble portion 22 of the cover 20. The upper portion 63 of the ring 61 overlays the horizontal brim 24 of cover 20 and the lower portion 69 of the retaining ring 61 directly overlays a portion of the metal roofing panel 12 adjacent the cover periphery 28. A layer 81 of elastomeric adhesive about 1/16 inch thick seals the horizontal, brim 24 to the roofing panel and to the bottom surface 67 of upper portion 63 of retaining ring 61. This layer 81 also extends between the bubble 22 and the retaining ring vertical side 75 and terminates in a elastomeric adhesive surface 83 flush with and generally parallel to the top surface 65 of the upper portion 63 of ring 61. A layer 85 of chemical adhesive, also about 1/16 inch thick, seals the lower portion 69 of the ring 61 to the metal roofing panel 12. This layer 85 extends from below the riser 79 to the retaining ring outer periphery 77.

Two different compounds are used to make the skylight 10 watertight. The compound which forms layer 17 between the inner cover 21 and lip 18 is an elastomeric material as is the material in layer 81. The layer 85 of material which secures the retaining ring 61 to the roofing panel 12 is a chemical adhesive. Each compound has properties which make it desirable for each of the above uses, as will be seen.

Several factors can lead to the creation of pressure differences between the building interior, the space 95 between the covers, and the outside atmosphere which stress the seal 17 between the lip 18 and the inner cover 21 and the seal 81 between the horizontal brim 24 and the roofing panel 12. First, modern ventilation systems often establish a negative pressure within a building which stresses the seal 17. The material which forms the layer 17 must therefore be flexible, but at the same time, must have elastic properties so that it is not extruded from between the lip 18 and the inner cover 21 when the pressure beneath the inner cover 21 is lower than the pressure in the space 95. A sealant having these qualities is available as a two-part epoxy from Kent Industries under the trade name Uni-Weld.

The seal 81 between the horizontal brim 24 and the roofing panel 12 does not need to be as flexible as the seal 17 between the lip 18 and the inner cover 21. Furthermore, the seal 85 need not bond to acrylic as do the other seals 17, 81. Some flexibility can therefore be traded for added strength. Suitable adhesives for forming the seal 85 are available from Dynatron Bondo Adhesives.

Secondly, as the outer cover 20 has a curved top surface, winds blowing across the outer cover 20 create a region of low pressure adjacent the outer cover 20 which tends to pull the cover 20 away from the roofing panel 12. A layer 81 of elastomeric adhesive is used between the retaining ring 61 and horizontal brim 24 and between the horizontal brim 24 and the roofing panel 12 to accommodate this stress. It will also be appreciated that the weeping paths 29 in the outer cover allow the space 95 between the covers 20, 21 to remain at the prevailing atmospheric pressure. This prevents the stresses on the outer cover 20 from being transferred to the inner cover 21.

Under extreme weather conditions with very high winds, the seal 81 between the horizontal brim 24 and the roofing panel 12 could fail. The present skylight 10 is designed so that in the rare event that this occurs, the outer cover 20 will not fly free. As can best be seen in FIG. 3, the horizontal brim 24 has a length greater than the distance between the retaining ring 61 and the lip 18. Thus, the outer cover 20 is mechanically locked between the retaining ring 61 and the lip 18 and cannot come free even if the seal 81 fails.

Figure 4:
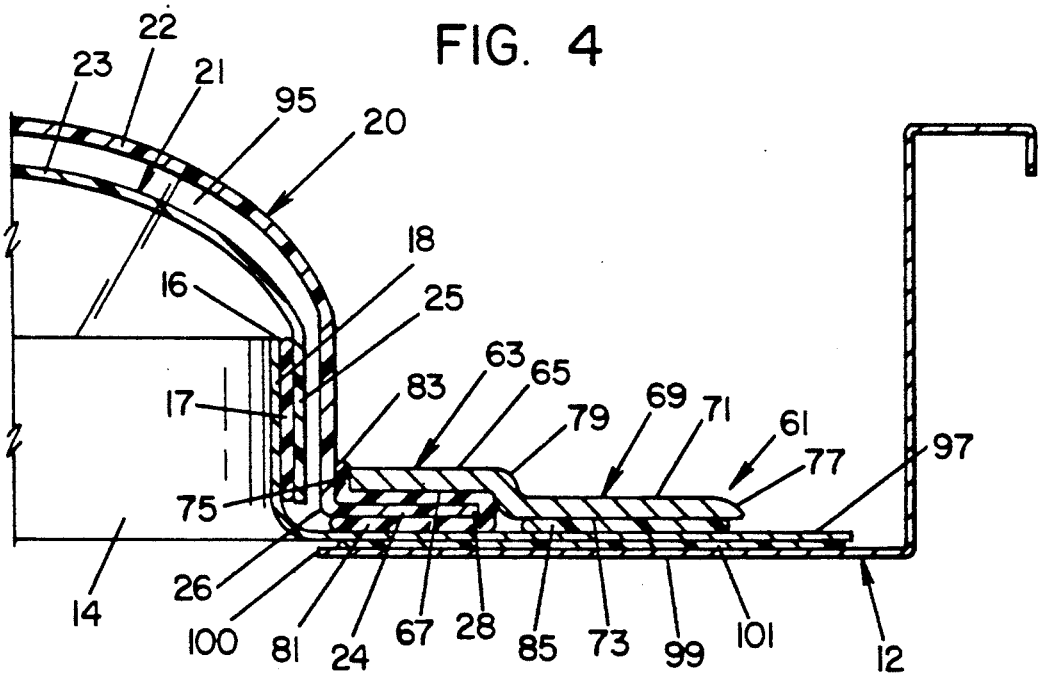
FIG. 4 is a cross-section of a skylight according to a second embodiment of the present invention.

A second embodiment is shown on FIG. 4, wherein elements common to both embodiments are designated by the same reference numerals. This embodiment is useful when a skylight is to be installed in an existing metal roofing system. This embodiment is similar to the skylight just described but includes an auxiliary panel 97 instead of metal roofing panel 12. The layer 81 of elastomeric adhesive and the layer 85 of chemical adhesive seal horizontal brim 24 and the ring 61 to the auxiliary panel 97 instead of to the metal roofing panel 12 as disclosed above. The auxiliary panel 97 can then be transported to a job site and sealed over a hole 100 in a metal roof 99 using a layer 101 of chemical adhesive. In this manner, the present invention can be practiced on metal roofs after they are completed without first removing a panel from the roof.

Figure 9:
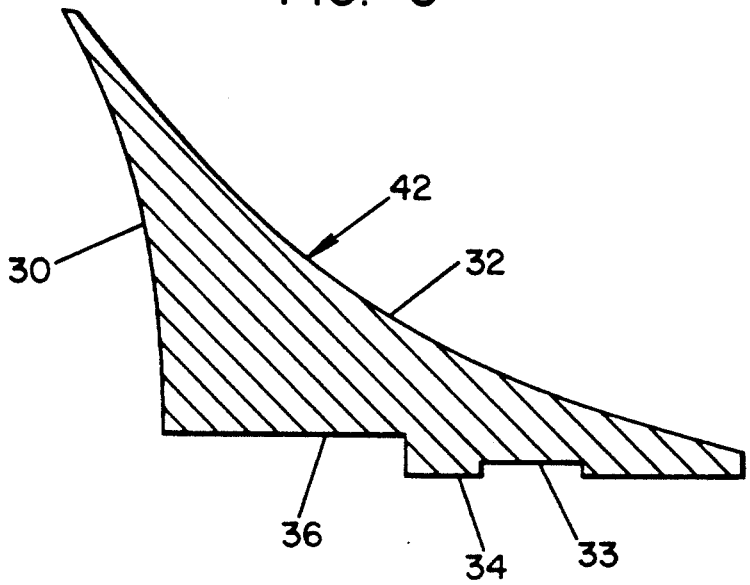
FIG. 9 is a cross-section of the molding of the skylight shown in FIG. 5.
Figure 10:
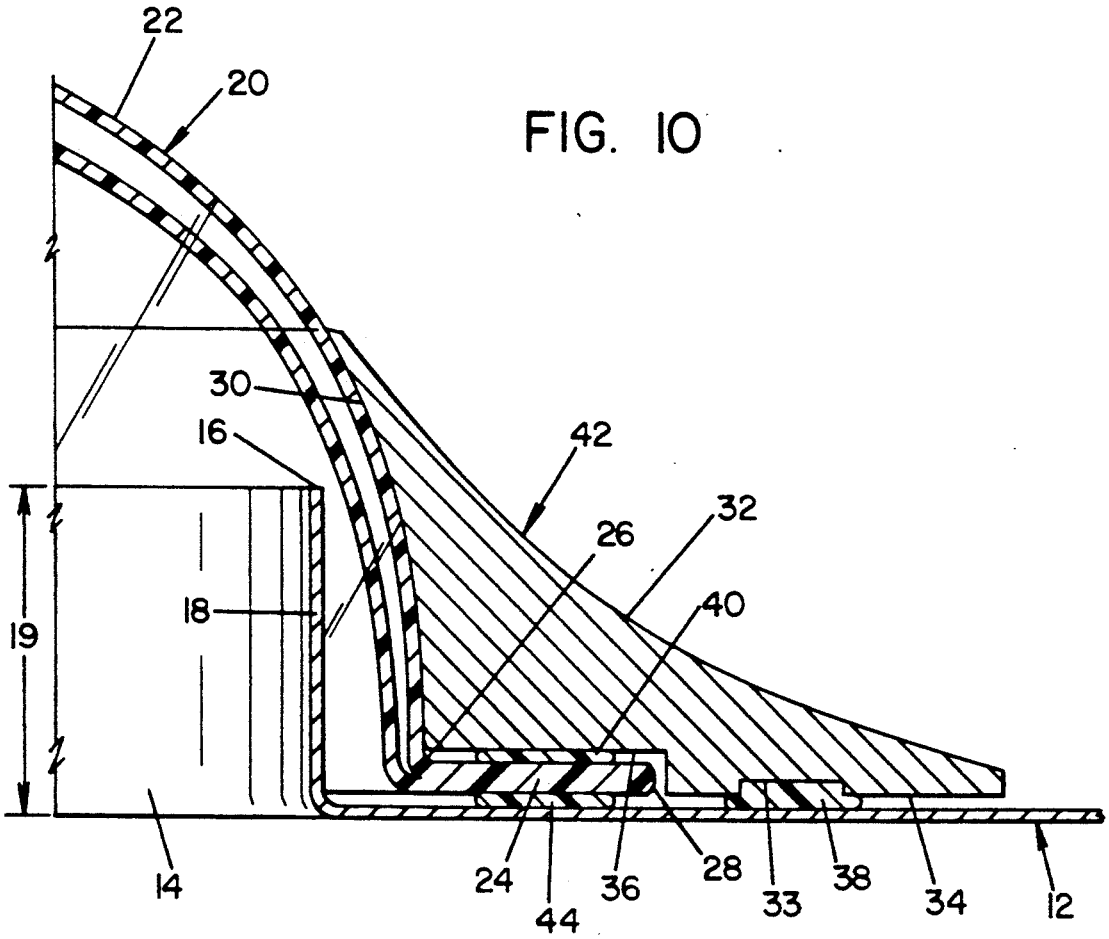
FIG. 10 is a cross-section of the skylight shown in FIG. 5.
Figure 11:
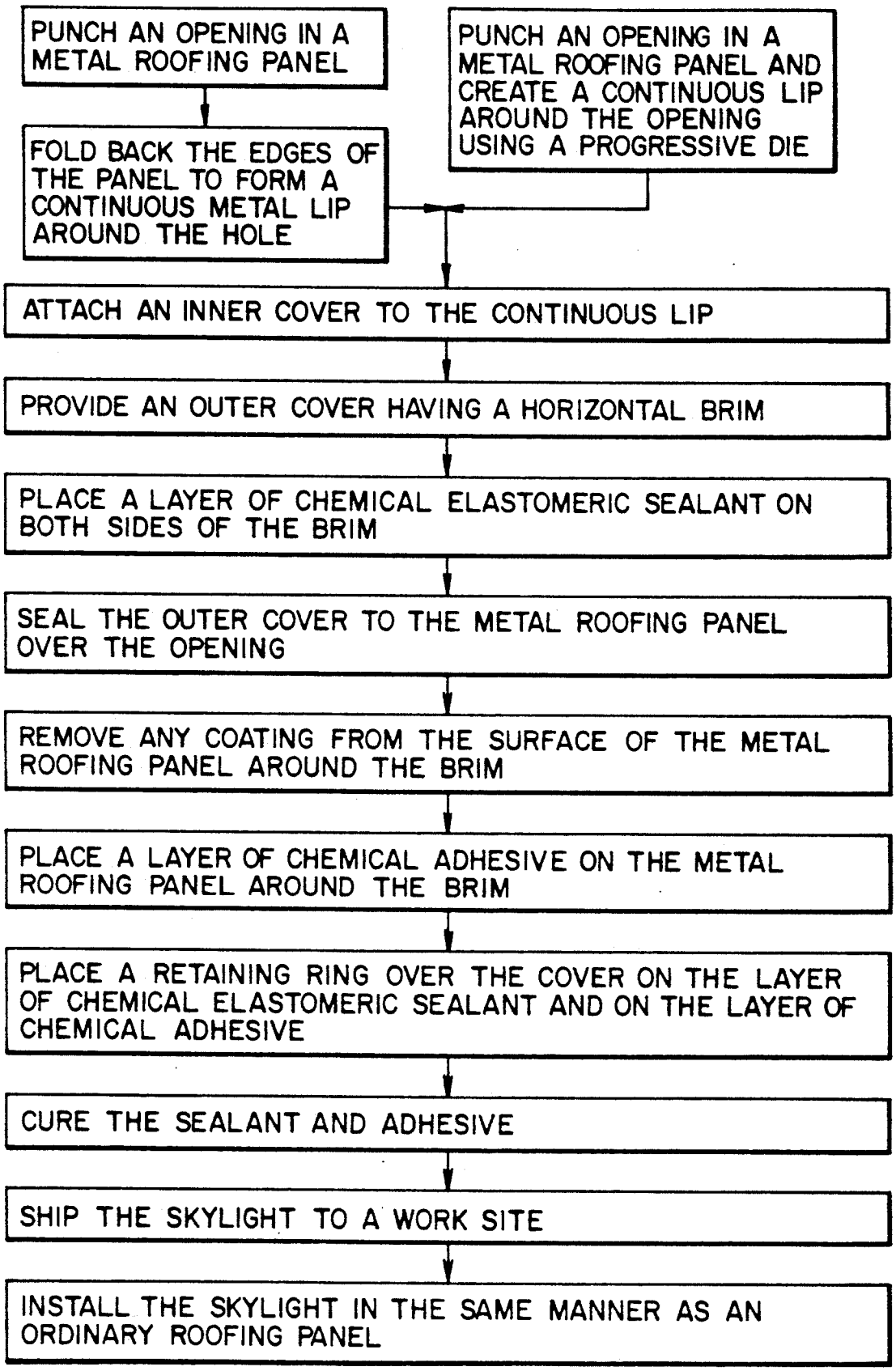
FIG. 11 is a flow chart showing the steps needed to assemble the skylight of FIG. 1.

FIGS. 5-7 and 9-10 show a third preferred embodiment, wherein elements common to other embodiments are designated by the same reference numerals, in which the retaining ring 61 is replaced by a molding 42. The inner cover 21 is optional in this embodiment and is not shown in these figures, but if used, it would be attached in the same manner as in the other embodiments. The molding 42 includes a contoured lateral surface 30, a curved top surface 32, a bottom surface 34 and cutout 36 in the bottom surface 34. The molding 42 fits snugly around the cover 20 with the contoured lateral surface 30 conforming generally to the shape of the lower portion of the bubble 22. The bottom surface 34 lays directly over metal panel 12. The horizontal brim 24 fits within the cutout 36. A layer 38 of chemical adhesive binds the molding 42 to the panel 12 while additional chemical adhesive 40 binds the molding 42 to the brim 24 of the cover 20. As shown in FIGS. 9 and 10, a recess 33 may be provided in the bottom surface 34 of the molding 42 to allow more chemical adhesive to be used. A bead 44 of chemical adhesive may be placed between the brim 24 and the panel 12 for a more reliable seal.

Figure 5:
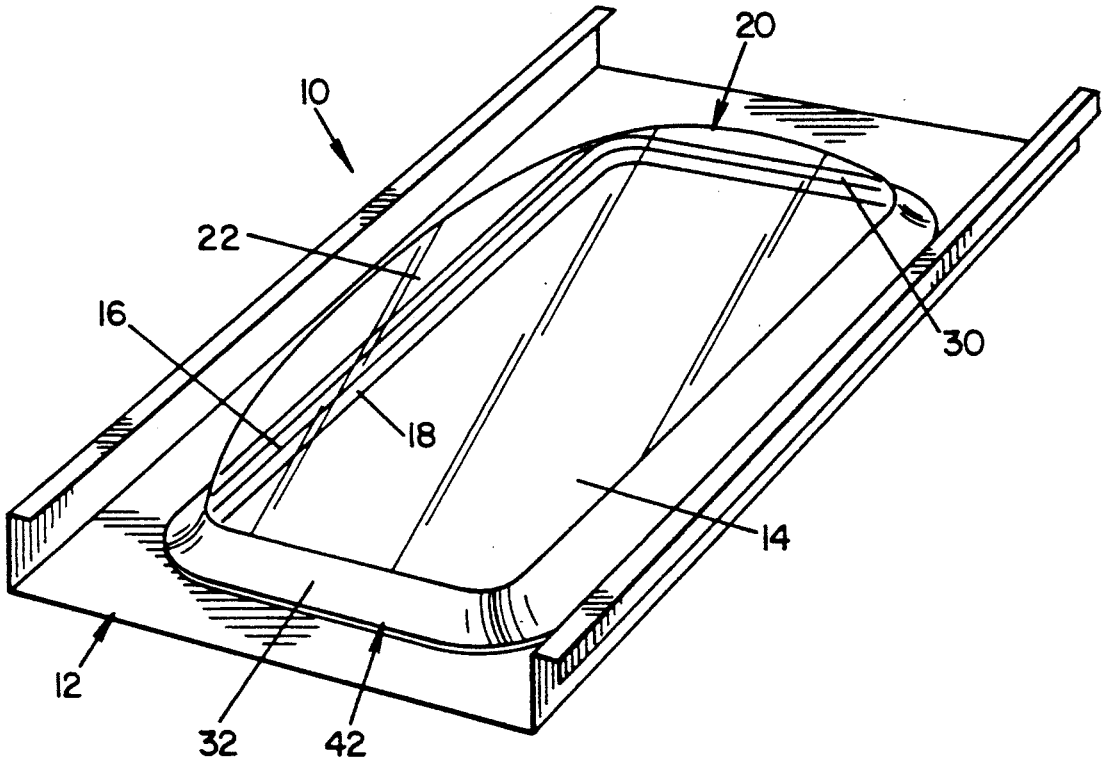
FIG. 5 is a perspective view of a skylight according to a third embodiment of the present invention.
Figure 6:
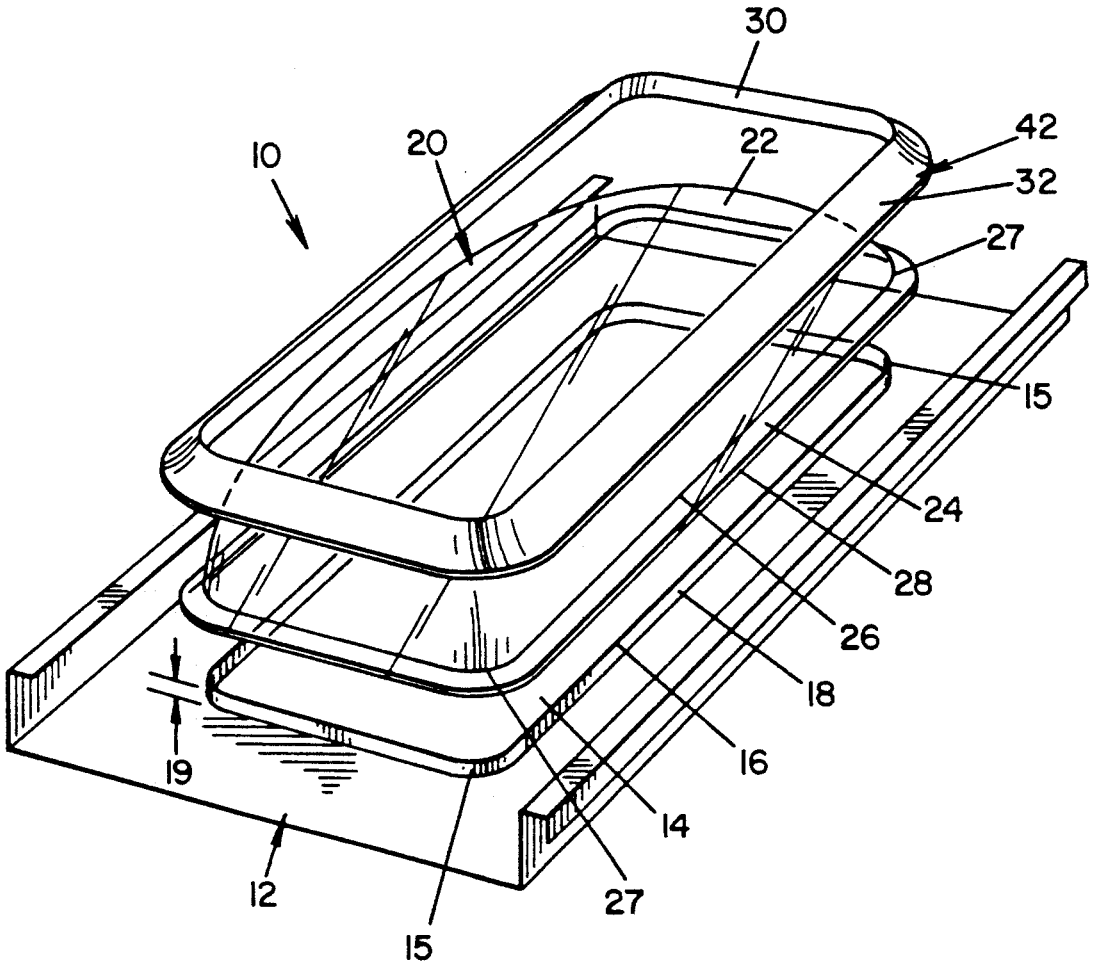
FIG. 6 is an exploded view of the skylight of FIG. 5.
Figure 7:
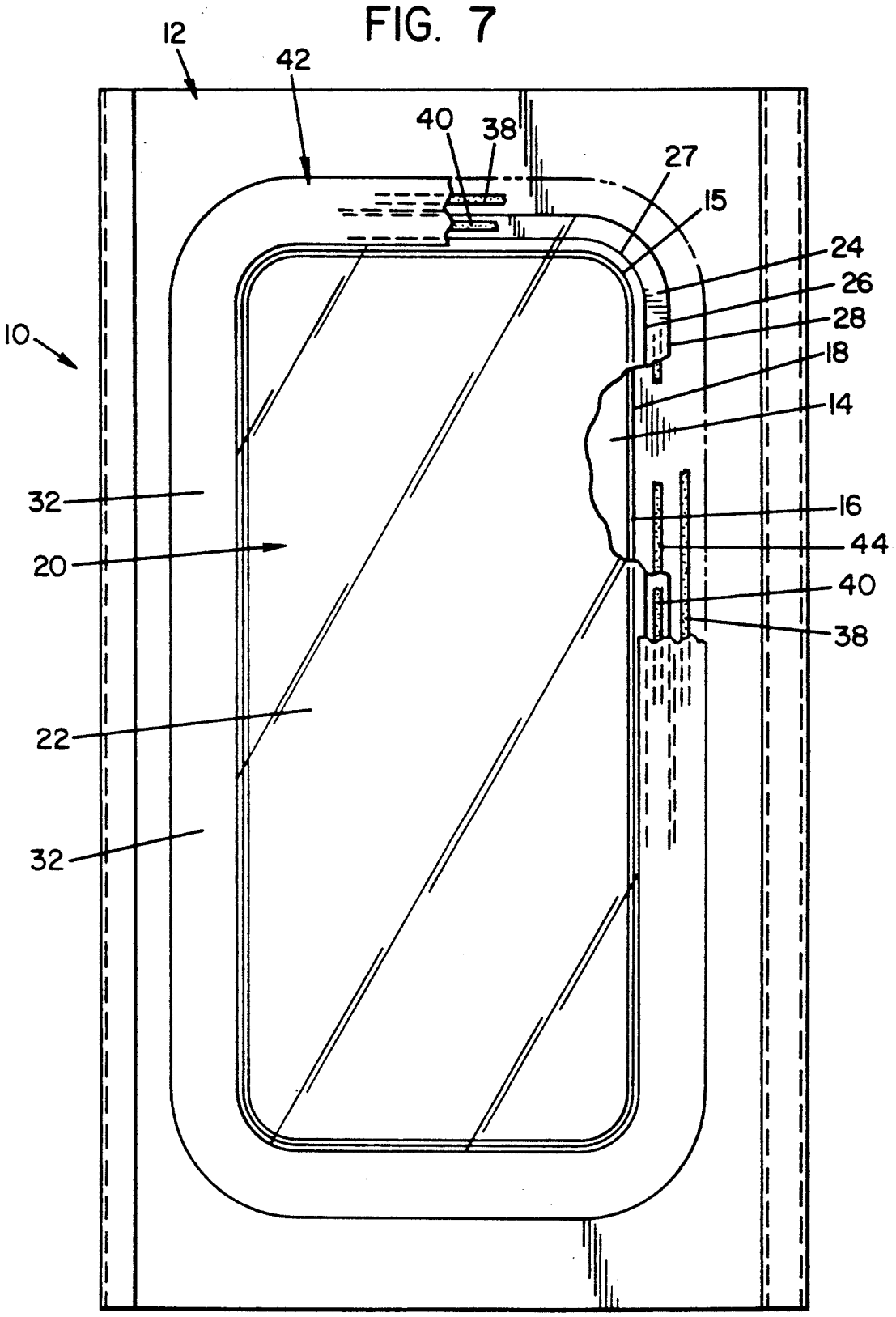
FIG. 7 is a top view, partially in section of the skylight shown in FIG. 5.

FIG. 10 is a cross-sectional view of the panel 12, the cover 20 and the molding 42 in their assembled state. As can be seen in FIG. 5, when the molding 42 is in place, both the lip 18 and the brim 24 are covered by the molding 42. Furthermore, the contoured lateral surface 30 fits against the bubble 22 in such a way that a smooth transition from the bubble 22 to the molding 42 is accomplished. This prevents water from building up at the junction of the bubble 22 and the molding 42 and possibly breaching the integrity of the system. The smooth transition from the curved top surface 32 to the roofing panel also encourages a smooth flow of water around the skylight so that no ice dam forms against the molding 42.

The structure herein defined represents a novel approach to preventing the leakage associated with skylights. Furthermore, the method of manufacturing such a skylight away from the job site and then installing it in the same manner as an ordinary roofing panel represents a further advance over the prior art which required specialized skilled labor on site.

FIG. 10 shows the steps involved in making the skylight assembly of FIG. 1. An opening 14 is punched in a standard metal roofing panel 12. The edges 16 are folded back from the opening 14 to make an upstanding, continuous lip 18. This lip 18 is coated with a layer 17 of elastomeric adhesive and an inner cover 21 is attached thereto. The horizontal brim 24 of outer cover 20 is then coated with a layer 81 of elastomeric adhesive and placed over the opening 14 and the inner cover 21, and thereby sealed to metal roofing panel 12. A layer 85 of chemical adhesive is placed on the metal panel 12 adjacent the cover periphery 28 of the cover 20. All surfaces on which the chemical adhesive or elastomeric adhesive are to be used should be cleaned before application to remove any foreign materials, protective coatings such as terne, and metal oxides to ensure the formation of the best possible seal. A retaining ring 61 is then placed over the cover 20 so that a portion 63 of the ring 61 rests on the layer 81 of elastomeric adhesive and a portion 69 of the ring 61 rests on the layer 85 of chemical adhesive. The layers 17, 81 of elastomeric adhesive and the layer 85 of chemical adhesive are then allowed to cure. The skylight 10 is then installed in a roof in the same manner as an ordinary roofing panel.

Movement of the ring 61 relative to the panel 12 or the cover 20 during the curing process could result in defects in the seals formed between the ring 61, panel 12 and cover 20. Thus, while these steps could be accomplished after the panel 12 was installed in a roofing system, the resulting skylight might not be as watertight as a unit which was allowed to cure in a factory under controlled conditions.

Figure 12:
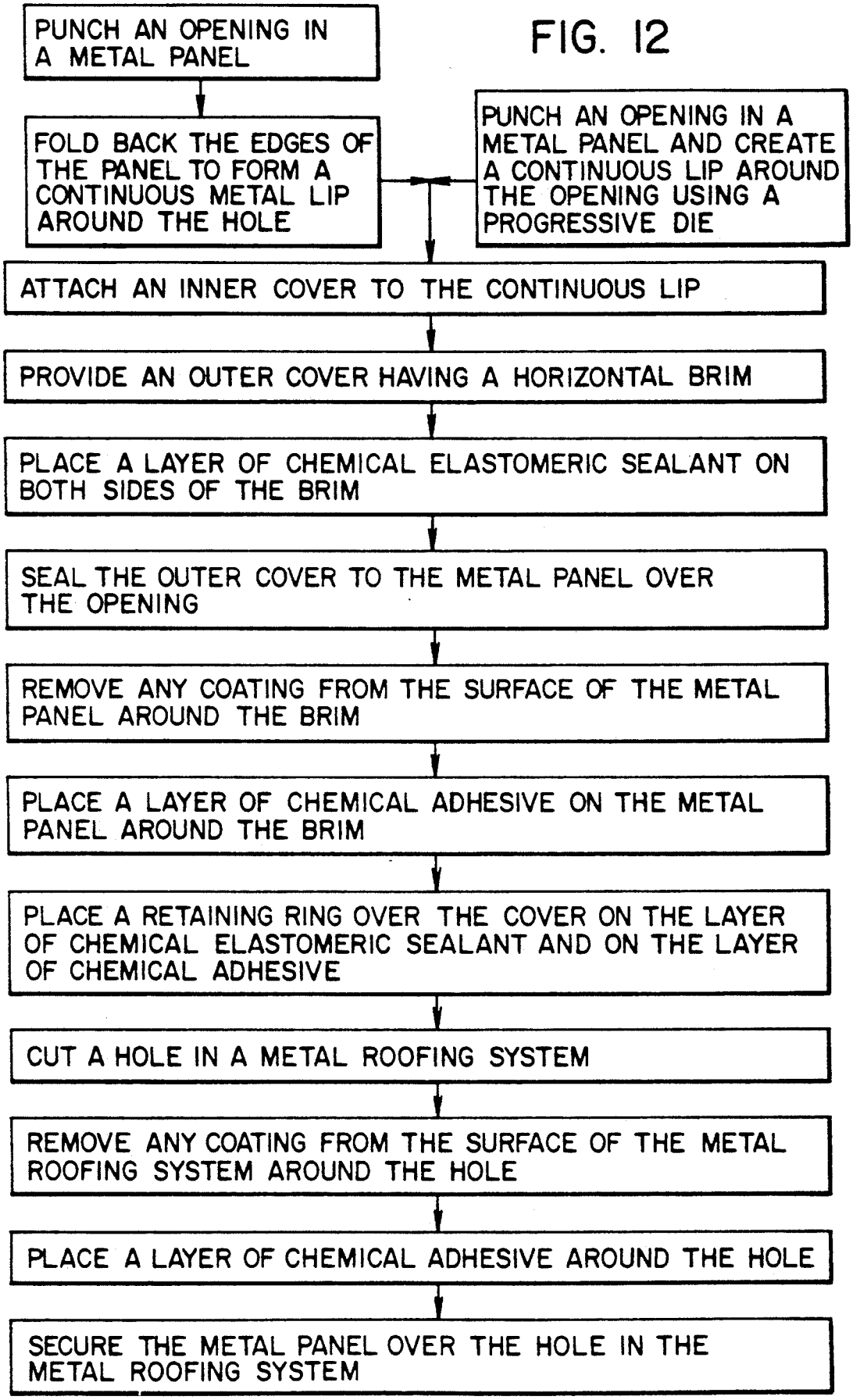
FIG. 12 is a flow chart showing the steps needed to assemble the skylight of FIG. 4.

FIG. 12 shows the steps of assembling the second embodiment of the present invention. This method is similar to the method of assembling the first embodiment, except that an auxiliary panel 97 is used instead of a metal roofing panel 12. An opening 14 is punched in the auxiliary panel and an inner cover 21, an outer cover 20 and a retaining ring 61 are all assembled as in the first embodiment. When the sealant layers have cured, the skylight is taken to the job site. There a hole 100 is cut in an existing metal roof 99. A layer 101 of chemical adhesive is placed on the metal roof 99 and the auxiliary panel 97 is placed on this layer 101 over hole 100. This allows a skyight substantially the same as the skylight 10 of the first embodiment to be installed in a pre-existing roof without necessitating the replacement of an entire roofing panel.

Figure 13:
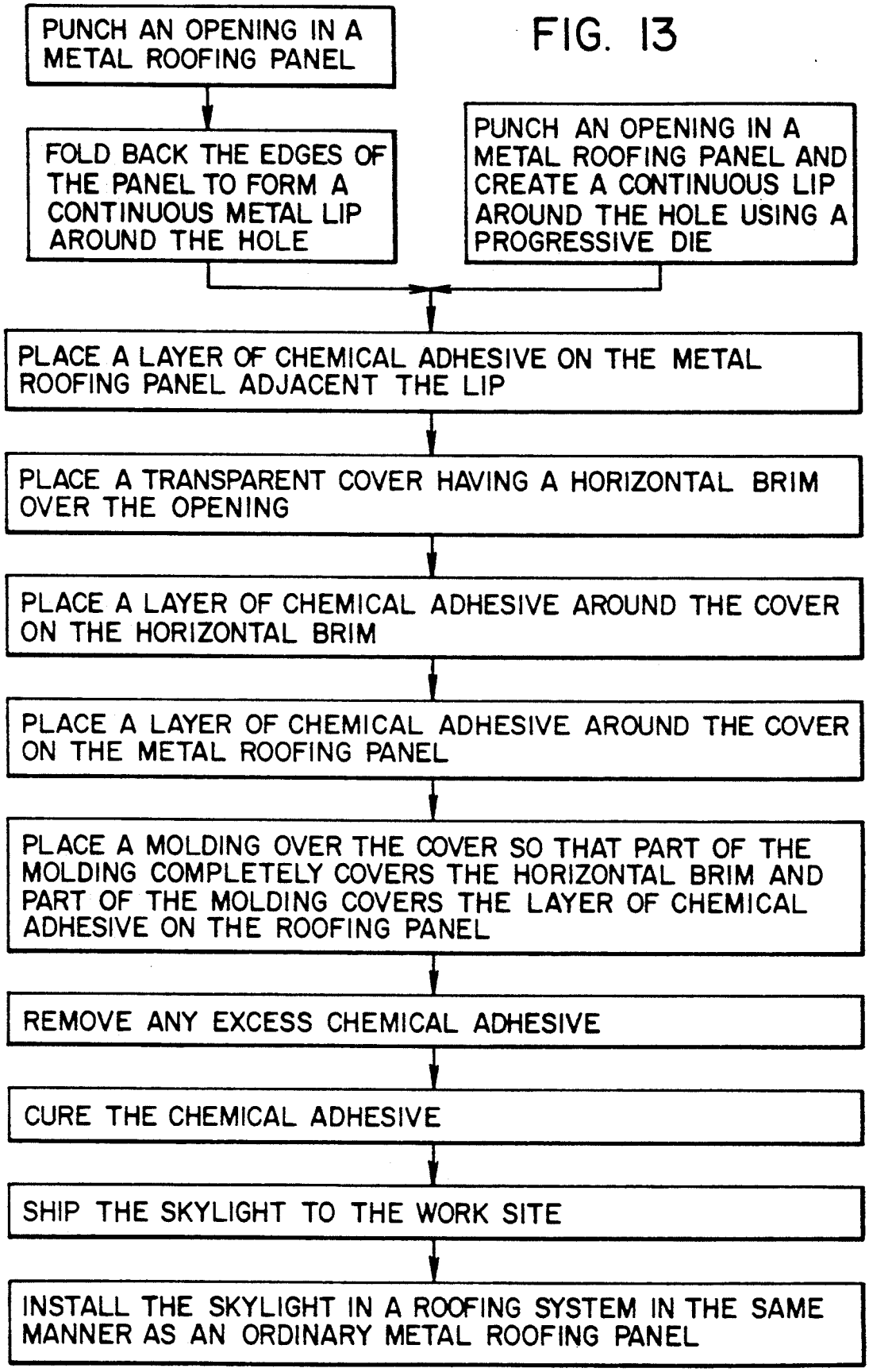
FIG. 13 is a flow chart showing the steps needed to assemble the skylight of FIG. 5.

A method of assembling the third embodiment of the present invention is shown in FIG. 13. The skylight 10 is created by punching an opening 14 in the panel 12 and bending the edges 16 away from the opening 14 to create the lip 18. An inner cover 21 may be attached to the lip 18 using a layer 17 of elastomeric adhesive. As in the method of assembling the first embodiment, the surfaces on which the adhesives are to be placed must first be cleaned. The outer cover 20 is placed over the opening 14 and the lip 18 so that the horizontal brim 24 of the cover 20 rests on the metal panel 12. A layer 40 of chemical adhesive is placed on the brim 24 between the bubble periphery 26 and the cover periphery 28. The layer 38 completely surrounds the bubble periphery 26. A second layer 38 of chemical adhesive is laid on the roofing panel 12 adjacent the cover periphery 28 and surrounding the cover 20. Both of the layers 38, 40 are sufficiently thick to allow for thermal expansion. The molding 42 is then placed over the opening 14 so as to completely cover and rest directly on the layers 38, 40 of chemical adhesive. This assembly is then kept stationary while the chemical adhesive cures. When the completed skylight assembly 10 is fully cured, it can be shipped to the building site and installed in essentially the same manner as an ordinary roofing panel.

The invention has been described with reference to a preferred embodiment. Obviously, modifications and alterations will occur to others upon reading and understanding of this specification. It is intended to include all such modifications and alterations in so far as they come within the scope of the appending claims or the equivalent thereof.

What is claimed is:

1. A curbless skylight comprising;

a metal roofing panel having an opening therein, said opening having edges which are bent away from the opening into an upstanding lip; and, a transparent cover attached to said roofing panel over said opening.

2. A skylight according to claim 1 including an inner cover and an outer cover.

3. A skylight according to claim 2 including a molding around said cover.

4. A curbless skylight comprising:

a metal roofing panel having an opening therein, said opening having edges which are bent away from the opening into an upstanding lip;

a transparent outer cover attached to said roofing panel over said opening; and a transparent inner cover over said opening and attached to said upstanding lip.

5. A skylight according to claim 4 in which said outer cover includes a bubble portion, a horizontal brim, and an outer periphery.

6. A skylight according to claim 5 in which said molding overlays said horizontal brim and directly overlays a portion of said metal roofing panel.

7. A skylight according to claim 6 in which said molding covers said bubble from said cover periphery to beyond the point at which said upturned sides would intersect said bubble if said sides were extended.

8. A skylight according to claim 7 in which said molding comprises:

a curved lateral surface which fits snugly against a curved side of said bubble;

5 a curved top surface which slopes gently from said roofing panel to said side of said bubble; and a bottom surface.

9. A skylight according to claim 8 in which said bottom surface of said molding includes a cutout to accommodate said horizontal brim.

10. A skylight according to claim 9 in which said bottom surface includes at least one recess adapted to accommodate a layer of chemical adhesive.

11. A skylight according to claim 10 including means for forming a watertight seal between said molding and said metal roofing panel.

12. A skylight according to claim 11 in which said means for forming a watertight seal comprise a layer of chemical adhesive.

13. A skylight according to claim 11 including means for forming a watertight seal between said molding and said plastic bubble.

14. A skylight according to claim 13 in which said means for forming a watertight seal comprises a layer of elastomeric adhesive.

15. A skylight according to claim 13 including means for forming a watertight seal between said plastic bubble and said roofing panel.

16. A skylight according to claim 15 in which said means for forming a watertight seal comprises a layer of elastomeric adhesive.

17. A skylight according to claim 16 in which said layer of chemical adhesive is approximately 1/32–1/16 inches thick.

18. A skylight according to claim 5 in which said outer cover includes at least one opening in said bubble portion.

19. A skylight according to claim 18 including a retaining ring around said outer cover.

20. A skylight according to claim 19 in which said transparent outer cover comprises a generally rectangular periphery having rounded corners.

21. A skylight according to claim 19 in which said transparent cover includes generally parallel sides and full radius ends.

22. A skylight according to claim 21 in which the greatest vertical distance between said horizontal brim and a point on said bubble is between one and five inches.

23. A skylight according to claim 22 in which said opening is about 11" by 48".

24. A skylight according to claim 23 in which said upturned edges are of a uniform cross section and height and which form a continuous barrier around said opening.

25. A skylight according to claim 24 in which said lip is between 0.5" and 1.00" high.

26. A skylight according to claim 25 in which said lip is approximately ¾" high.

27. A skylight according to claim 26 in which said lip is perpendicular to said roofing panel.

28. A skylight according to claim 27 in which said inner dome and said outer dome are separated by a distance of about ⅜ inches.

29. A skylight according to claim 28 in which the distance between said bubble periphery and said cover periphery is at least ½ inch.

30. A skylight according to claim 19 wherein said outer cover is mechanically locked in place by said retaining ring.

31. A skylight according to claim 30 in which said retaining ring overlays said horizontal brim and directly overlays a portion of said metal roofing panel.

32. A skylight according to claim 31 in which said retaining ring, said inner cover and said outer cover include full radius ends.

33. A skylight according to claim 32 in which said retaining ring comprises:

an upper portion overlaying said horizontal brim; and, a lower portion overlaying said metal roofing panel.

34. A skylight according to claim 33 in which said retaining ring is comprised of aluminum.

35. A skylight according to claim 33 in which said retaining ring is comprised of plastic.

36. A skylight according to claim 33 in which said retaining ring is comprised of a composite, moldable material.

37. A skylight according to claim 33 including means for forming a watertight seal between said retaining ring and said metal roofing panel.

38. A skylight according to claim 37 in which said seal comprises a layer of chemical adhesive.

39. A skylight according to claim 37 including means for forming a watertight seal between said retaining ring and said outer bubble.

40. A skylight according to claim 39 in which said seal comprises a layer of elastomeric adhesive.

41. A skylight according to claim 39 including means for forming a watertight seal between said outer bubble and said roofing panel.

42. A skylight according to claim 41 in which said seal comprises a layer of elastomeric adhesive.

43. A skylight comprising:

a metal roofing panel having an opening therein, said opening having edges upturned to form an upstanding lip, said edges being of a uniform cross section and height and forming a continuous barrier around said opening;

a transparent inner cover comprising a bubble portion and a vertical portion;

a transparent outer cover including a bubble, a horizontal brim, a bubble periphery and a cover periphery, said bubble periphery and cover periphery having generally parallel sides and full radius ends;

a retaining ring around said cover having an upper portion overlaying said horizontal brim and a lower portion directly overlaying said metal roofing panel.

44. A skylight comprising:

a metal roofing panel having an opening therein, said opening having edges upturned to form an upstanding lip, said edges being of a uniform cross section and height and forming a continuous barrier around said opening;

a transparent cover including a bubble, a horizontal brim, a bubble periphery and a cover periphery, said bubble periphery and cover periphery having generally parallel sides and full radius ends;

a molding around said cover having a lateral surface curved to fit snugly against said bubble, a top surface which slopes gently against said bubble, and a bottom surface including a cut out to accommodate said horizontal brim and one or more recesses to accommodate beads of chemical adhesive.

* * * * *